US006601622B1

(12) United States Patent
Young

(10) Patent No.: US 6,601,622 B1
(45) Date of Patent: Aug. 5, 2003

(54) PERSONAL ACCESSORY WITH QUICK-ACCESS

(75) Inventor: Raymond Wallace Young, Blue Jay, CA (US)

(73) Assignee: TBAC Investment Trust, Arlington, TX (US)

( * ) Notice: Subject to any disclaimer, the term of this patent is extended or adjusted under 35 U.S.C. 154(b) by 0 days.

(21) Appl. No.: 10/025,542

(22) Filed: Dec. 18, 2001

(51) Int. Cl.[7] ..... A45C 1/06; A45C 1/18; A45C 13/42

(52) U.S. Cl. ..... 150/138; 150/133; 150/145; 150/148; 206/39.4

(58) Field of Search ..... 150/131, 133, 150/134, 138, 139, 141, 145, 147–149; 206/39.4

(56) References Cited

U.S. PATENT DOCUMENTS 1,128,136 A * 2/1915 Hano ..... 150/147
1,463,619 A * 7/1923 Gardner ..... 150/149 X
1,585,051 A * 5/1926 Skoglund ..... 150/149 X
1,832,625 A * 11/1931 Gardner, Jr. ..... 150/149 X
2,008,220 A * 7/1935 Miyeno ..... 150/133
2,113,037 A * 4/1938 St. Thomas et al. ..... 150/139
2,306,001 A * 12/1942 Struhl ..... 150/139
2,368,040 A * 1/1945 Pitar ..... 150/139
2,428,267 A * 9/1947 Doppelt ..... 150/139 X
2,475,067 A * 7/1949 Wege ..... 150/133 X
2,544,618 A * 3/1951 Smith ..... 150/147 X
2,592,918 A * 4/1952 Loncich ..... 150/139
2,748,821 A * 6/1956 Hutchinson ..... 150/139
3,120,253 A * 2/1964 St. Thomas ..... 150/138
3,856,063 A * 12/1974 Dengel ..... 150/147 X
5,263,523 A * 11/1993 Scheunemann ..... 150/147 X
5,881,788 A * 3/1999 Hersh et al. ..... 150/148 X
6,105,298 A * 8/2000 Grayson et al. ..... 150/148 X

* cited by examiner

*Primary Examiner*—Sue A. Weaver
(74) *Attorney, Agent, or Firm*—James J. Murphy, Esq.; Winstead Sechrest & Minick, P.C.

(57) ABSTRACT

A personal accessory includes an outer cover and a pocket disposed within the body and accessible through an aperture through the outer cover. A holder includes a peripheral frame defining at least one window for receiving and holding a substantially flat object, the holder adapted to be inserted into and extracted from the pocket. A tether has a first end attached to the body at a point within the pocket and a second end attached to the holder, the holder rotatable around the second end of the tether when the holder is substantially extracted from the pocket. A quick release mechanism is selectively provided within selected pockets of the personal accessory and includes a corresponding plurality of pocket liners attached to a rigid sheet. Manual force applied to the rigid sheet forces substantially flat objects within the selected pockets outward from those pockets for rapid access and extraction.

20 Claims, 6 Drawing Sheets

100

PERSONAL ACCESSORY WITH QUICK-ACCESS

FIELD OF INVENTION

The present invention relates in general to personal accessories, such as wallets, billfolds, pocketbooks and the like and in particular, to a personal accessory with quick-access.

BACKGROUND OF INVENTION

In an increasingly security conscious society, the presentation of a driver's license or other form of picture identification is often required to close a transaction or gain access to a physical space. For example, proper identification is normally required to cash a check or pay a merchant with a check or credit card. Moreover, a picture ID is mandatory for travelers wishing to gain access to the secured areas of airports. Moreover, the purchase alcoholic beverages and tobacco products is typically restricted to those who can present valid proof of age.

Driver's licenses and similar plastic card forms of identification (ID cards) are the most convenience, since they are thin, light and durable. In particular, ID cards can easily be carried in a pocket in a billfold or pocketbook. In some instances, the pocket may include a window of clear plastic which allows the face of the ID card to be visible without removal from the pocket itself. Notwithstanding, presenting an ID card on demand still remains a somewhat awkward process.

For example, if the billfold or pocketbook does not include a windowed pocket, then the card must be removed, presented, and then returned to its pocket after use. Even if a window is provided, the billfold or pocketbook must be folded open such that the ID card is visible and the entire inner surface presented to the viewing party. Hence, not only is the ID visible, but also at least some of the presenter's other property, such as credit cards or cash which are only partially concealed by a pocket or other receptacle.

One possible solution is disclosed in U.S. Pat. No. 2,748,821 to Hutchinson for Pass Case Wallet. Here, a pocket is provided on the outer surface of a conventional wallet. A plurality of simple transparent plastic envelopes are fastened by an extendable element within the walls of the wallet such that they may be inserted or extended into the pocket without unfolding the wallet. Passes or similar cards may be placed within these plastic envelopes. A single stiff or semi-stiff backing is provided for the plurality of envelopes, while the envelope edges remain unprotected from damage from the processes of extending and retracting. Moreover, the ends of the plastic envelopes are loose and appear to separate when extended from their pocket.

In sum, some means is required which allows a driver's license or other ID card to be quickly presented, as required, and then as quickly be returned to the owner's billfold or pocketbook. Additionally, the other contents of the billfold or pocketbook should be protected against unintended viewing. Finally, the design should be rugged, aesthetically pleasing, and securely hold the ID, card or other object.

SUMMARY OF INVENTION

The principles of the present invention are embodied in personal accessories, such as billfolds, wallets, tri-folds, pocketbooks and cardfolds which include means allowing the user quick access to credit cards, id cards and the like.

According to one embodiment of the inventive principles, a personal accessory is disclosed which includes a body having an outer cover and a pocket disposed within the body and accessible through an aperture through the outer cover. A holder includes a peripheral frame defining at least one window for receiving and holding a substantially flat object, the holder adapted to be inserted into and extracted from the pocket. A tether is included which has a first end attached to the body at a point within the pocket and a second end attached to the holder, such that the holder is rotatable around the second end of the tether when the holder is substantially extracted from the pocket.

Personal accessories embodying the inventive principles have substantial advantages over the prior art. Among other things, means are provided which allow a driver's license or other form of ID to be quickly presented, as required, and as quickly to be returned to a secure position. Moreover, the other contents of the personal accessory are protected against unintended viewing at the same time. Finally, personal accessories embodying these principles are rugged, aesthetically pleasing and securely hold the identification card, credit card or other flat object placed in the holder.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION

The principles of the present invention and their advantages are best understood by referring to the illustrated embodiment depicted in FIGS. 1–5C of the drawings, in which like numbers designate like parts.

Figure 1B:
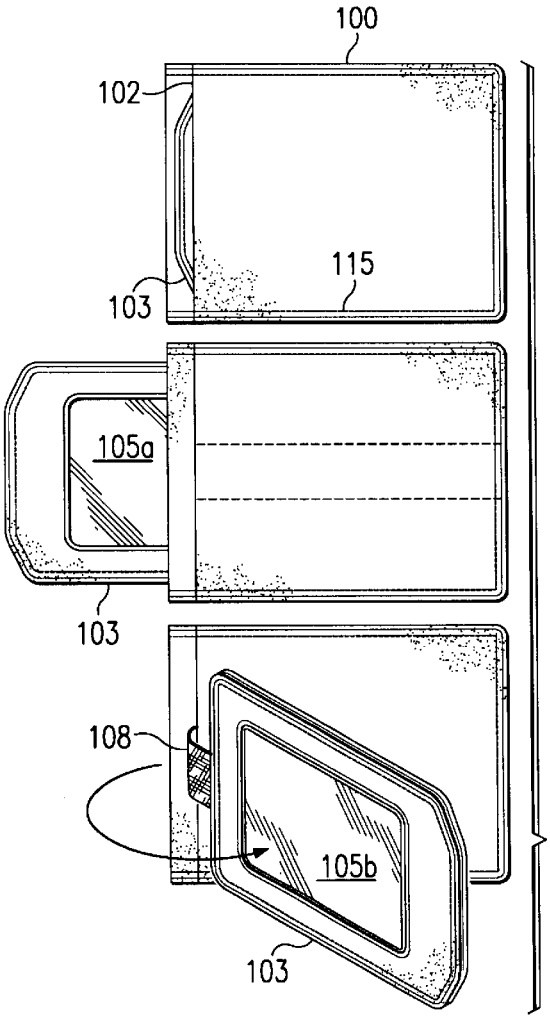
FIGS. 1A and 1B are plan views of the exterior of a billfold according to the principles of the present invention and illustrating the extension and retraction of the tethered card holder feature.
Figure 1A:
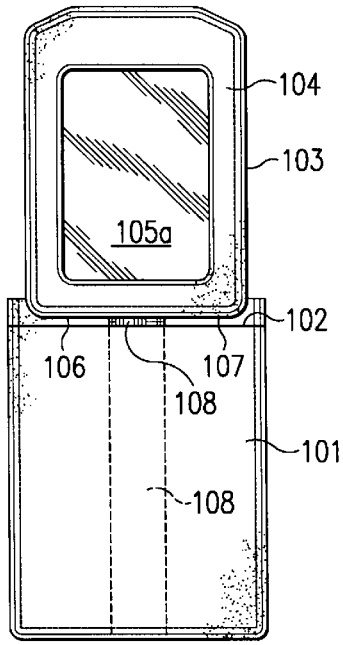

FIG. 1A is a diagram showing a plan view of a billfold 100 according to one embodiment of the inventive concepts. Specifically, in FIG. 1 one major exterior surface 101 of the outer cover of is billfold 100 is shown, with billfold 100 in a folded (or closed) configuration (the open configuration will be discussed in conjunction with FIG. 1C).

According the inventive concepts, an externally accessible pocket 102 is provided which allows slidable access to an ID card holder 103 while billfold 100 is folded closed. Card holder 103 preferably includes a peripheral support structure or frame 104 and front and back windows 105*a,b*. An ID card (not shown) may be inserted into card holder 103 through a slot or aperture 106 at the proximal end 107 of card holder such that the front and back sides of the ID card are visible through windows 105*a,b*. Altematively, a pair of ID cards may be inserted back-to-back such that one side of each is visible through the corresponding window 105*a,b*.

A band of flexible material 108 forms a connector or leash/tether which connects card holder 103 with the body of billfold 100. Preferably, connector 108 comprises a ribbon of tin or similar metal sewn into the body of billfold 100 approximately as shown in FIG. 1A. Construction of connector 108 is not limited to metal ribbons; other flexible strips of material such as plastic, leather, or fabric may also be used. The length of connector 108 is sufficient to allow card holder 103 to fully extend from pocket (slot) 102. When extended, card holder 103 rotates or folds with respects to the body of the billfold. This action is illustrated in FIG. 1B.

Advantageously, a relatively rigid construction of card holder frame realizes substantial advantages over similar structures employing simple transparent plastic envelopes. Among other things, frame 104 allows card holder 103 to be extended and inserted into slot 102 with minimal binding or impedance. Moreover, when card holder 103 is extended, frame 104 provides a protection against fraying, wear, or other damage to the edges of windows 105*a,b*, as well as protection for any card contained in the holder. Additionally, frame 104 makes card holder 103 more aesthetically pleasing than a simple plastic envelope, especially when the card holder it extended from the body of billfold 100 during presentation of an ID contained therein. Finally, frame 100 insures that a contained card does not accidentally slip from card holder 103, even during rapid movements of the card holder into and out of pocket 102.

Figure 1C:
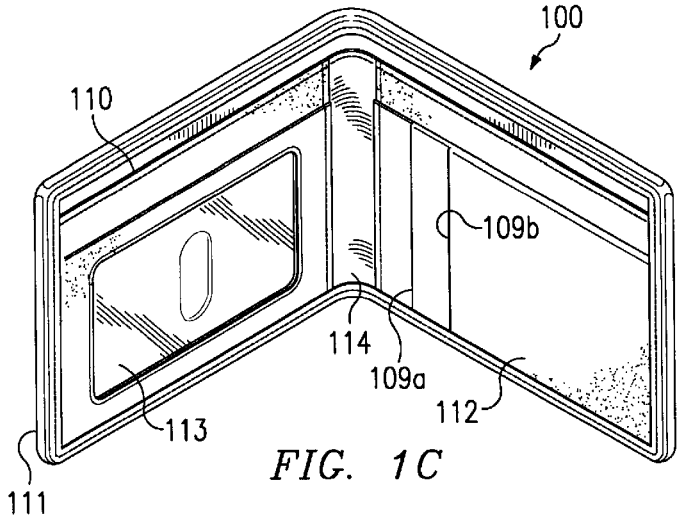
FIG. 1C is a plan view of the interior of the billfold shown in FIGS. 1A and 1B.

One possible inner arrangement of billfold 100 is shown in FIG. 1C. Here, billfold is folded open to reveal a plurality of pockets 109 for receiving credit cards or the like, a lengthwise pocket 110 between the outer wall or cover 111 and the inner wall or cover 112 for receiving and holding currency, and an internal windowed pocket 113 providing an additional holder for an ID card or other relatively flat object requiring quick visibility. A flexible region 114 in outer cover 111 and inner surface 112 allows billfold 100 to fold into closure.

Billfold 100, including the outer and inner cover (surfaces) of the main body and the outer surfaces of frame portion of card holder 103, are preferably constructed from leather. A preferred stitching arrangement is shown generally at 115. It should be noted that billfold 100 can be constructed, in whole or in part, from other natural materials, such as animal skin or hide, or synthetic materials, such as nylon. The windows are preferably constructed from plastic or similar clear or semi-clear material.

Figure 2A:
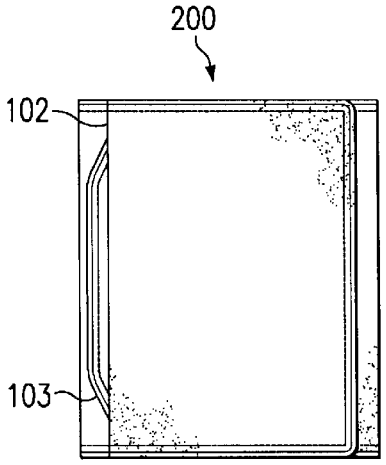
FIGS. 2A and 2B are plan views of the exterior of a tri-fold embodiment of the principles of the present invention, also illustrating the extension and retraction of the tethered card holder feature.
Figure 2B:
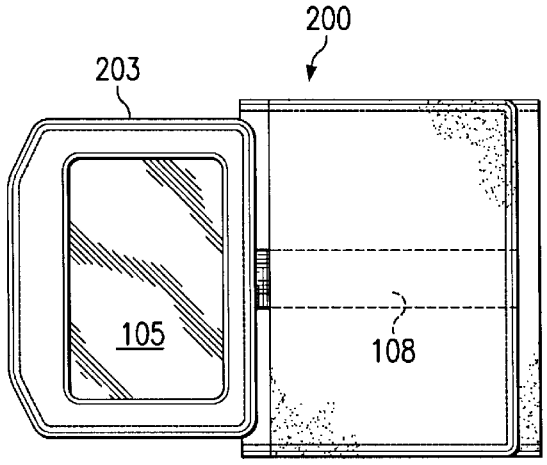
Figure 2C:
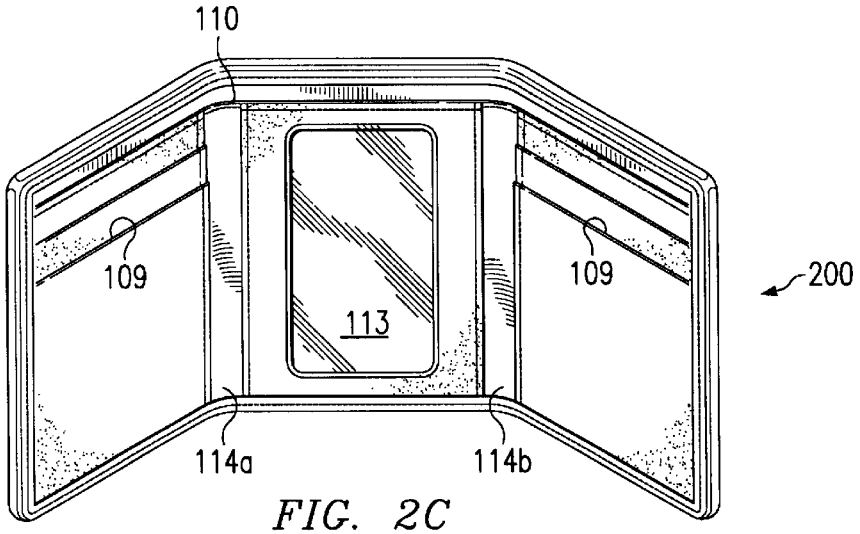
FIG. 2C is a plan view of the tri-fold shown in FIGS. 1A and 1B.

FIGS. 2A–2C show an alternate tri-fold embodiment 200 of the inventive principles. The construction is similar to that of billfold 100 and includes external pocket 102 and tethered ID holder 203. FIG. 2A shows tri-fold 200 in a folded or closed configuration with card holder fully inserted into pocket 102. Card holder 103 is shown extended in FIG. 2B and one possible inner tri-fold arrangement is shown in FIG. 2C.

Figure 3A:
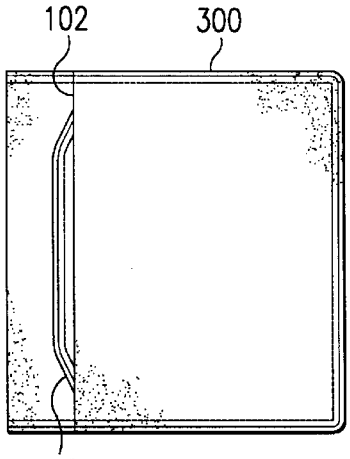
FIGS. 3A and 3B are plan views of the exterior of a credit cardfold embodiment of the principles of the present invention and further illustrating the movement of the tethered card holder feature.
Figure 3B:
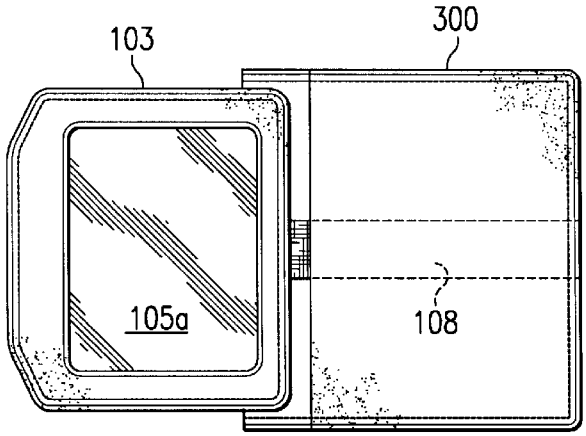
Figure 3C:
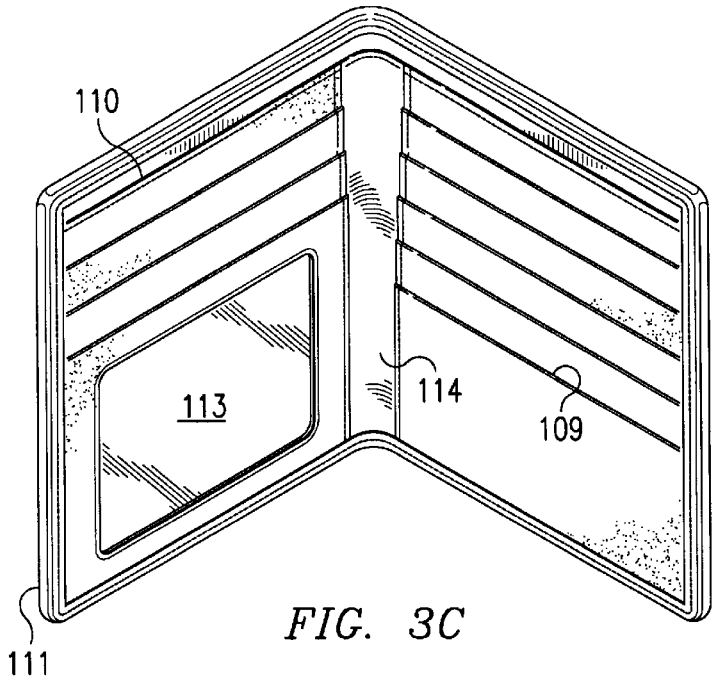
FIG. 3C is a plan view of the credit cardfold shown in FIGS. 3A and 3B.
Figure 4A:
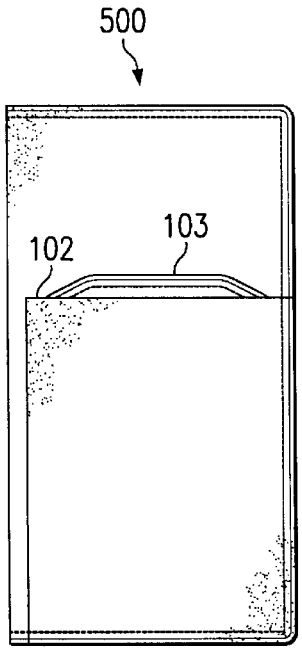
FIGS. 4A and 4B are plan views of the exterior of a pocketbook embodiment of the principles of the present invention and illustrating the movement of the tethered card holder feature.
Figure 4B:
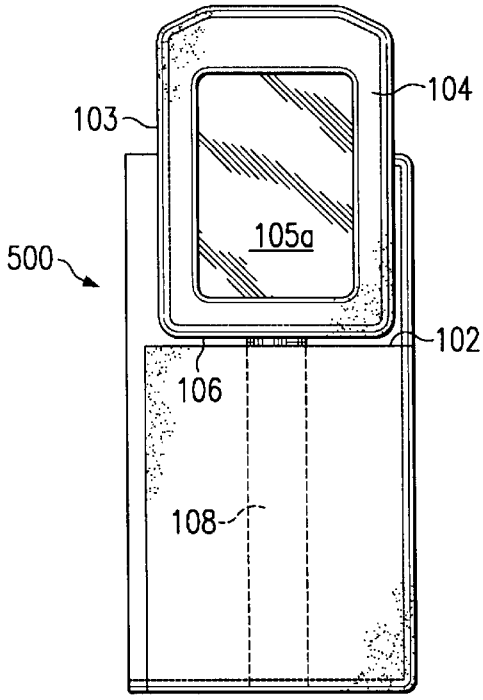
Figure 4C:
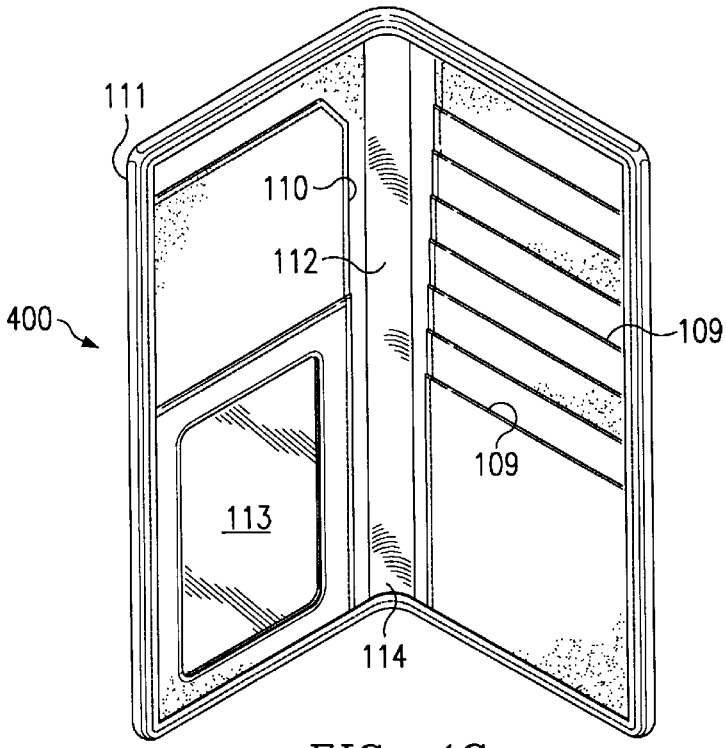
FIG. 4C is a plan view of the pocketbook shown in FIGS. 4A and 4B.

Similar views are provided in FIGS. 3A–3C for a credit card fold embodiment 300 and in FIGS. 4A–4C for a pocketbook embodiment 400. In each case, the construction and tethered ID card case features are similar to those described above; the overall dimensioning, number of pockets for credit cards, and folding arrangements differ as a matter of basic design.

Figure 5A:
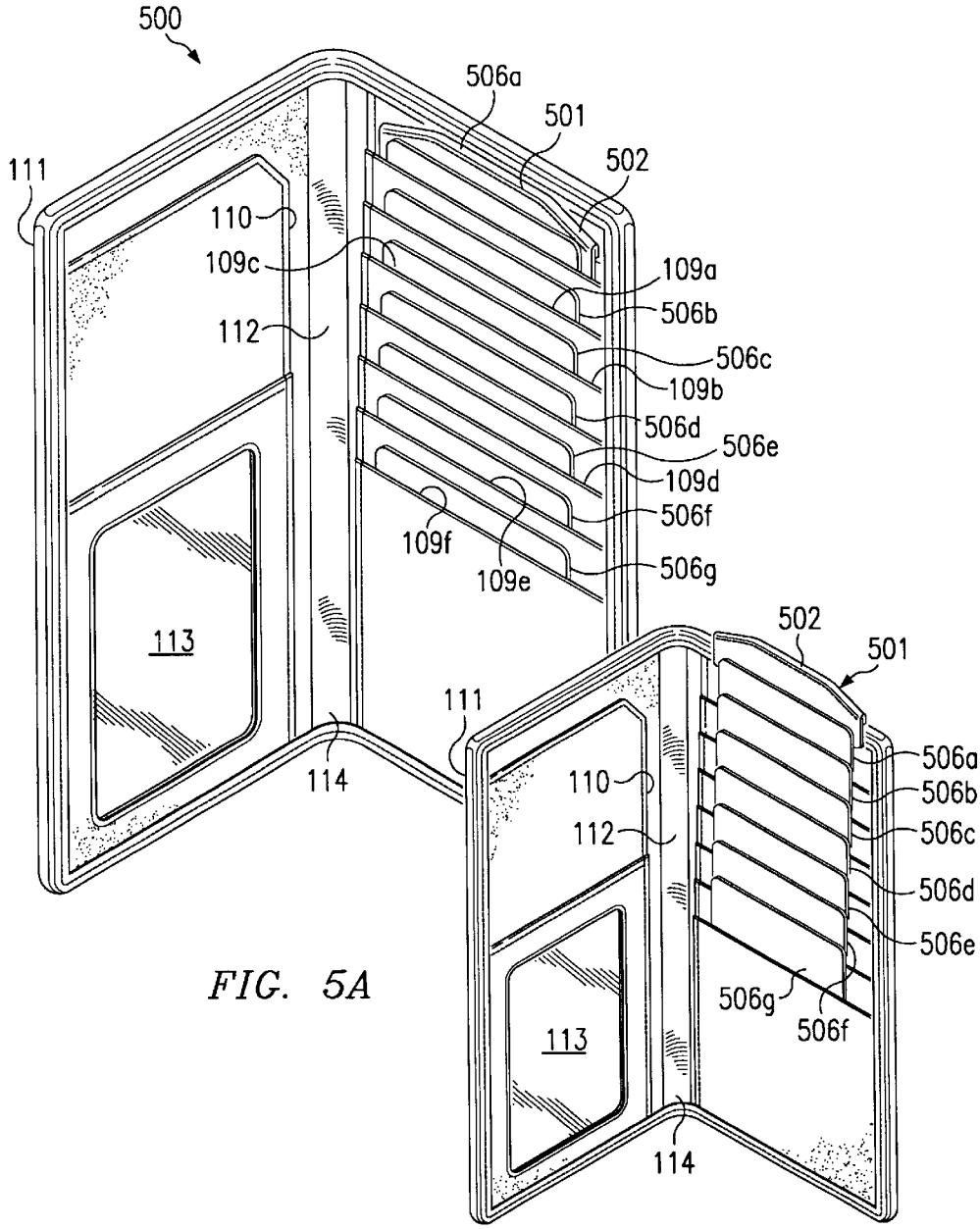
FIG. 5A are plan view diagrams of the interior of a pocketbook with a card-release according to the principles of the present invention and showing the cardrelease in retracted and extended configurations.

FIG. 5A illustrates a billfold or wallet 500 with a card release mechanism 501 according to further inventive principles which allows cards, such as credit cards, ID cards, drivers licenses and the like, to be quickly accessed from their pockets, such as pockets 109 already described. In particular, FIG. 5A shows billfold 500 with card release mechanism 501 in both the retracted and extended positions discussed below. A portion of release mechanism in shown exploded detail in FIGS. 5B and 5C respectively in the extended and retracted positions.

A tab or extension 502, designed for a manual exertion of force, extends from the upper pocket 109*a*. Tab 502 is preferably the distal portion of a rigid or semi-rigid sheet 503, which could for example be made of plastic and which extends downward, at least past the bottom of the lining lowest pocket described below. Preferably, tab 502 is trimmed with leather or another material designed to match the remainder of the inner cover of the wallet.

Each pocket 109*a,g* is formed by a lining 504*a,e* with one lining end sewn or otherwise attached to sheet 503. The other end of each lining 504*a,e* is attached to a corresponding leather pocket top 505*a,e* which is in turn sewn or otherwise attached to the inner lining or cover of billfold 501.

Figure 5B:
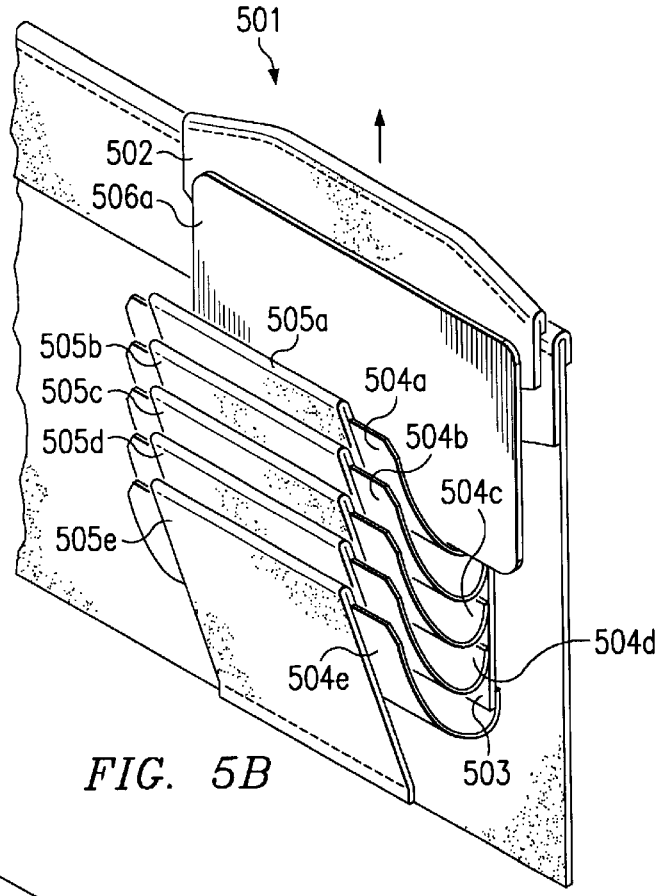
FIGS. 5B and 5C are enlarged exploded views of the card-release.
Figure 5C:
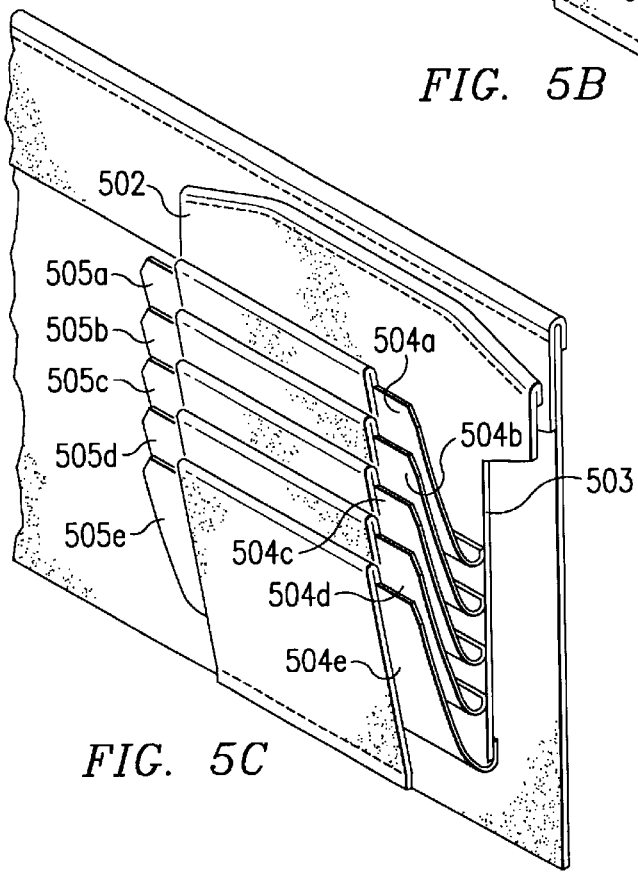

In use, a credit card, ID card or similar flat object 505 is inserted into a selected pocket 109. In FIG. 5B, a single credit card 506*a,g* is shown and in FIG. 5A each pocket or slot is shown with a card 506*a,g* inserted, for reference. In actual use, the number of slots containing a card or similar flat object, such as a key, will depend on the needs of the user.

In the card storage configuration shown in the upper diagram of FIG. 5A, each card is securely protected within its pocket. When a card is needed, the user simply pulls on tab 502 which in turn pulls linings 504*a,e*, along with sheet 503 outward from the body of billfold 500, as shown in the lower diagram of FIG. 5A. Any card or cards inserted into pockets 109 are forced outward by linings 504 for quick access by the user. When the user is finished, tab 502 is pressed or pushed inward to return any inserted cards or objects back within their corresponding pockets 109.

It should be noted that billfold 500 can also include an external pocket and tethered card holder as described above. Moreover, each the embodiments described above can also include a card release mechanism similar to that described in conjunction with billfold 500.

Although the invention has been described with reference to a specific embodiments, these descriptions are not meant to be construed in a limiting sense. Various.modifications of the disclosed embodiments, as well as alternative embodiments of the invention will become apparent to persons skilled in the art upon reference to the description of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore, contemplated that the claims will cover any such modifications or embodiments that fall within the true scope of the invention.

What is claimed is:

1. A personal accessory comprising:

a body including an outer cover;

a pocket disposed within said body and accessible through an aperture through said outer cover;

a holder including a peripheral frame defining at least one window for receiving and holding a substantially flat object, said holder adapted to be inserted into and extracted from said pocket; and a tether having a first end attached to said body at a point within said pocket and a second end attached to said holder, said holder rotatable fully extractable from said pocket about said second end of said tether when said holder is substantially extracted from said pocket.

2. A The personal accessory of claim 1 wherein said body includes an inner cover including at least one pocket for holding a substantially flat object comprising:

a slidable sheet disposed between said inner and outer covers of said body;

a lining attached to said inner cover and said slidable sheet to define a receptacle for receiving the substantially flat object; and means for manually engaging said slidable sheet for projecting the substantially flat object from said receptacle for access.

3. The personal accessory of claim 1 wherein said personal accessory is selected from the group consisting of billfolds, tri-folds, pocketbooks and card folds.

4. The personal accessory of claim 1 wherein said substantially flat object comprises a plastic card.

5. The personal accessory of claim 1 wherein said tether comprises a metal ribbon.

6. The personal accessory of claim 1 and further comprising a sheet of substantially transparent material covering said window of said holder.

7. The personal accessory of claim 1 wherein said outer cover comprises a leather cover.

8. The personal accessory of claim 1 wherein said frame of said holder comprises a leather outer surface.

9. The personal accessory of claim 1 wherein said tether is attached along a substantial length of an inner lining of said pocket.

10. A personal accessory comprising:

a body including a pocket having an aperture defined through a surface of the body;

an ID card holder comprising a peripheral frame supporting sidewalls adapted to receive an ID card, at least one of the sidewalls being substantially transparent to define a window, the ID card holder adapted to be slidably inserted and extended from the pocket; and a tether coupling the ID card holder and the body, the ID card holder fully extractable from the pocket and rotatable at a distal end of the tether with respects to the body when the ID card holder is extended from the pocket.

11. The personal accessory of claim 10 wherein the pocket is accessible through an aperture)defined through an outer cover of the body.

12. The personal accessory of claim 10 wherein the tether is flexible along a substantial portion of its length.

13. The personal accessory of claim 10 the tether is attached to the body along a substantial portion of its length.

14. The personal accessory of claim 10 wherein the tether is attached to the body at a point within the pocket.

15. The personal accessory of claim 10 and further comprising a second pocket including a card release mechanism.

16. The personal accessory of claim 15 wherein the card release mechanism comprises:

a slidable sheet forming a sidewall of the second pocket;

a lining attached to the slidable sheet and a pocket top of the second pocket to define a receptacle for receiving a card; and a tab for manually engaging the slidable sheet for projecting the card from the receptacle for access.

17. The personal accessory of claim 15 wherein the second pocket is accessible through an aperture defined through an inner cover of the personal accessory.

18. The personal accessory of claim 10 wherein the personal accessory is selected from the group consisting of billfolds, wallets, pocketbooks, tri-folds and cardfolds.

19. The personal accessory of claim 10 wherein at least a portion of the tether comprises a metal ribbon.

20. The personal accessory of claim 10 wherein the body comprises an outer cover of leather.

* * * * *